US006533523B2

(12) United States Patent
Zamotin

(10) Patent No.: US 6,533,523 B2
(45) Date of Patent: Mar. 18, 2003

(54) WHEELCHAIR SYSTEM FOR TRANSFERRING OCCUPANT TO MOTOR VEHICLE

(76) Inventor: Rodvinon I. Zamotin, 259 Nahkoda Dr., Miami Springs, FL (US) 33166

( * ) Notice: Subject to any disclaimer, the term of this patent is extended or adjusted under 35 U.S.C. 154(b) by 0 days.

(21) Appl. No.: 09/874,967

(22) Filed: Jun. 7, 2001

(65) Prior Publication Data

US 2002/0187026 A1 Dec. 12, 2002

(51) Int. Cl.[7] ..... A61G 3/00

(52) U.S. Cl. ..... 414/343; 414/347; 414/921; 280/289 WC; 280/242 WC

(58) Field of Search ..... 414/343, 347, 414/462, 543; 280/242 WC, 289 WC

(56) References Cited

U.S. PATENT DOCUMENTS

| | | | | |
|---|---|---|---|---|
| 3,515,294 A | | 6/1970 | Southward et al. | |
| 3,865,427 A | | 2/1975 | Delany | |
| 4,170,368 A | | 10/1979 | Southward et al. | |
| 4,278,387 A | | 7/1981 | Seguela et al. | |
| 4,354,791 A | | 10/1982 | Antonellis | |
| 4,365,924 A | | 12/1982 | Brigman et al. | |
| 4,483,653 A | | 11/1984 | Waite | |
| 4,669,943 A | | 6/1987 | Zamotin | |
| 4,773,495 A | * | 9/1988 | Haubenwallner | 180/65.2 |
| 5,016,720 A | * | 5/1991 | Coker | 180/13 |
| 5,433,763 A | * | 7/1995 | Shagott et al. | 55/323 |
| 5,556,118 A | * | 9/1996 | Kern et al. | 280/47.16 |

* cited by examiner

*Primary Examiner*—Eileen D. Lillis
*Assistant Examiner*—Charles A. Fox
(74) *Attorney, Agent, or Firm*—Larson & Taylor PLC

(57) ABSTRACT

A wheelchair system for transferring a handicapped person onto an automobile seat includes a wheeled chassis whose front end is rolled beneath an automobile door opening, a horizontally extending base member, and a rotatable mounting mechanism for the base member. The rotatable mounting mechanism includes a first actuating linkage and a first driven member therefor. The wheelchair system also includes a chair supporting frame located centrally of the chassis and removably mounted on the base member. This chair supporting frame includes an adjusting mechanism for vertically adjusting a support thereof. A handle assembly is removably mounted to the chassis and includes a second linkage for rotating the first driven member. This second linkage includes a removable driving member which removably connects to the first driven member as the handle is removed and connected to the chassis, and a second driven member at an opposite end thereof.

23 Claims, 13 Drawing Sheets

WHEELCHAIR SYSTEM FOR TRANSFERRING OCCUPANT TO MOTOR VEHICLE

BACKGROUND OF THE INVENTION

The present invention relates to a wheelchair system, and more specifically to a wheelchair system which permits the chair to be easily separated from the wheeled chassis and properly positioned as desired on an automobile seat.

Heretofore there have been provided many mechanisms for transferring handicapped persons with little or no mobility into an automobile. Prior art devices include slings which are supported from hanging arms and which may position a person over a car seat and lower the person onto the seat. Because of the limited area provided for entrance into a car it is exceedingly difficult to maneuver a person into a car with such devices. Furthermore, of course, there is the additional difficulty in placing a patient in such a sling and removing the sling after transport.

There have been developed wheelchairs which permit the transfer of a person from a wheeled supporting frame into a vehicle or for bringing the entire wheelchair into the vehicle. U.S. Pat. Nos. 4,278,387; 4,170,368; 4,365,924; 4,354,791; 3,515,294; 3,865,427 and 4,483,653 are typical wheelchair designs of this type. All of these prior art devices require some modification of the structure of the automobile. These modifications include complete removal of the car seat, insertion of rotatable support arms within the car or insertion of trackways in the car seat.

A satisfactory wheelchair which permits the chair to be separated from the wheeled chassis and supported on an automobile seat, which requires no modification whatsoever of an automobile so that a person utilizing a wheelchair manufactured in accordance therewith may be transferred into any automobile quickly and easily without in any way altering the structure of the car, and which thus overcomes many of the problems noted above is disclosed in U.S. Pat. No. 4,669,943. The present invention is an improvement over this prior art wheelchair. The disclosure of U.S. Pat. No. 4,669,943 is hereby incorporated by reference.

BRIEF SUMMARY OF THE INVENTION

In accordance with the present invention, a wheelchair system for supporting a handicapped person and for transferring the handicapped person in the wheelchair through an automobile door opening and onto an automobile seat with no assistance from the handicapped person is provided. The wheelchair system includes a wheeled chassis having front and rear ends and being of a height to permit the front end of the chassis to be rolled beneath an automobile door opening. This wheeled chassis includes a horizontally extending base member, and a rotatable mounting means for rotatably mounting a front end of the base member to the front end of the chassis for rotation about a vertical axis. The rotatable mounting means includes a first actuating linkage by which the base member is rotated and a first driven member at an end of the first actuating linkage by which the first actuating linkage is rotated to incrementally rotate the base member as desired.

The wheelchair system of the present invention also includes a chair supporting frame located centrally of the chassis and removably mounted on a rear end of the base member. This chair supporting frame includes a vertically extending support member, and an adjusting means for vertically adjusting a position of the support member with respect to the base member. A handle assembly is also removably mounted to the rear end of the chassis. This handle assembly includes a second linkage for rotating the first driven member of the rotatable mounting means. This second linkage includes a removable driving member which removably connects to the first driven member of the rotatable member as the handle is removed and connected to the chassis, and a second driven member at an end of the second linkage opposite to the removable driving member.

A removable mounting means is further provided for removably mounting a chair in which the handicapped person sits in a cantilevered manner on an upper end of the vertically extending support member in vertical spaced relation to the wheeled chassis and in a position substantially overlying a length of the base member. With this construction, (a) when the chassis is rolled beneath an automobile door opening, the chair is positioned over the automobile seat, (b) when the chair is positioned over an automobile seat, the chair is then lowered onto the automobile seat and the chair supporting frame is disconnected from the chair, and (c) when the chair is separated from the chair supporting frame and the chassis, the chair supporting frame, the chassis and the handle assembly are then separated from one another for easy carrying and stowage (especially in a car trunk).

In a preferred embodiment of the wheelchair system, the handle assembly includes a pair of vertically extending support bars with free distal ends between which the second linkage is mounted. In addition, the chassis includes a handle mounting means for removably mounting the handle assembly to the chassis. This handle mounting means includes a pair of vertical support brackets having holes in which respective ones of the distal ends of the handle support bars are received.

Also in a preferred embodiment, the adjusting means includes an actuation member which is rotated to cause the position of the chair to move vertically and a portable electric driver having a driving tool which removably connects with the actuation member to rotate the actuation member. This portable electric driver is also easily carried and stowed. Further, the second driven member is a manual turning wheel located at a top of the handle assembly by which the removable driving member of the second linkage is easily rotated to cause the base member and hence the chair mounted thereon to rotate independent of the vertical positioning of the chair.

Further in a preferred embodiment, the chair includes rollers on a bottom thereof mounted for allowing the chair to easily roll sideways on a flat surface. Then, a flat chair plate is provided which is placed on the automobile seat and which is engaged by the rollers of the chair so as to facilitate movement of the chair into and out of the automobile. In addition, the chair includes a detachable left side which is removed once the handicapped person in seated on the car seat so as to facilitate use of a seat belt by the handicapped person. To provide the removable left side, the chair includes a left side frame member extending horizontally having a plurality of vertical holes therein, and the detachable left side includes a plurality of stub shafts extending vertically downwards therefrom which are removably received in respective ones of the plurality of vertical holes of the left side frame member in order to detachably mount the left side to the left side frame member.

Still further in a preferred embodiment, the wheelchair system includes a foot rest, a foot rest mounting means for mounting the foot rest to the chair for movement in a vertical plane, and a remote foot rest adjustment means for incrementally adjusting and holding the foot rest vertically relative to the chair from a position remote from the foot rest. Thus, the foot rest is adjustable so that the legs of the person are easily moved out of the way of the automobile as the chair is positioned through the automobile door opening and onto the automobile seat.

In the preferred embodiment, the foot rest mounting means includes a mounting bar mounted horizontally for rotation at a front of a seat of the chair and to which the foot rest is attached and a lever attached to one end of the mounting bar. In addition, the remote foot rest adjustment means includes a third linkage connected to the lever, a third driven member located remote from the foot rest which is rotated to activate the third linkage and hence to move the lever and the associated mounting bar incrementally for adjustment and holding of the foot rest, and a portable electric driver having a driving tool which removably connects with the third driven member to rotate the third driven member, which portable electric driver is also easily carried and stowed.

In this preferred embodiment, the remote foot rest adjustment means is mounted to the chair; and the third driven member is located adjacent an armrest of the chair. In addition, the third linkage includes a flexible cord attached at one end to the lever and a spool to which the other end of the flexible cord is attached and about which the flexible cord is wound/unwound to adjust and hold the foot rest. Further, the foot rest mounting means includes a single mounting arm extending from the mounting bar to the foot rest.

It is an object of the present invention is to provide a wheelchair for handicapped persons in which the chair may be positioned on the seat of an automobile while attached to the wheeled chassis of the wheelchair and in which the chair can be subsequently disconnected from the wheeled chassis.

It is another object of the present invention is to provide a wheelchair having a supporting structure which may be readily disassembled and stored when the chair is being used by a person being transported in an automobile. There are two advantages which result from the ease of disassembly of the wheelchair. First, the chair may be easily stored in a car trunk. Second, by being able to separate the chassis, the chair frame, and the handle, the separate parts are lighter and easier to lift.

Other objects and many of the attendant advantages of the present invention will become more readily apparent upon consideration of the following detailed description in connection with the accompanying drawings wherein:

DETAILED DESCRIPTION OF THE INVENTION

Figure 1:
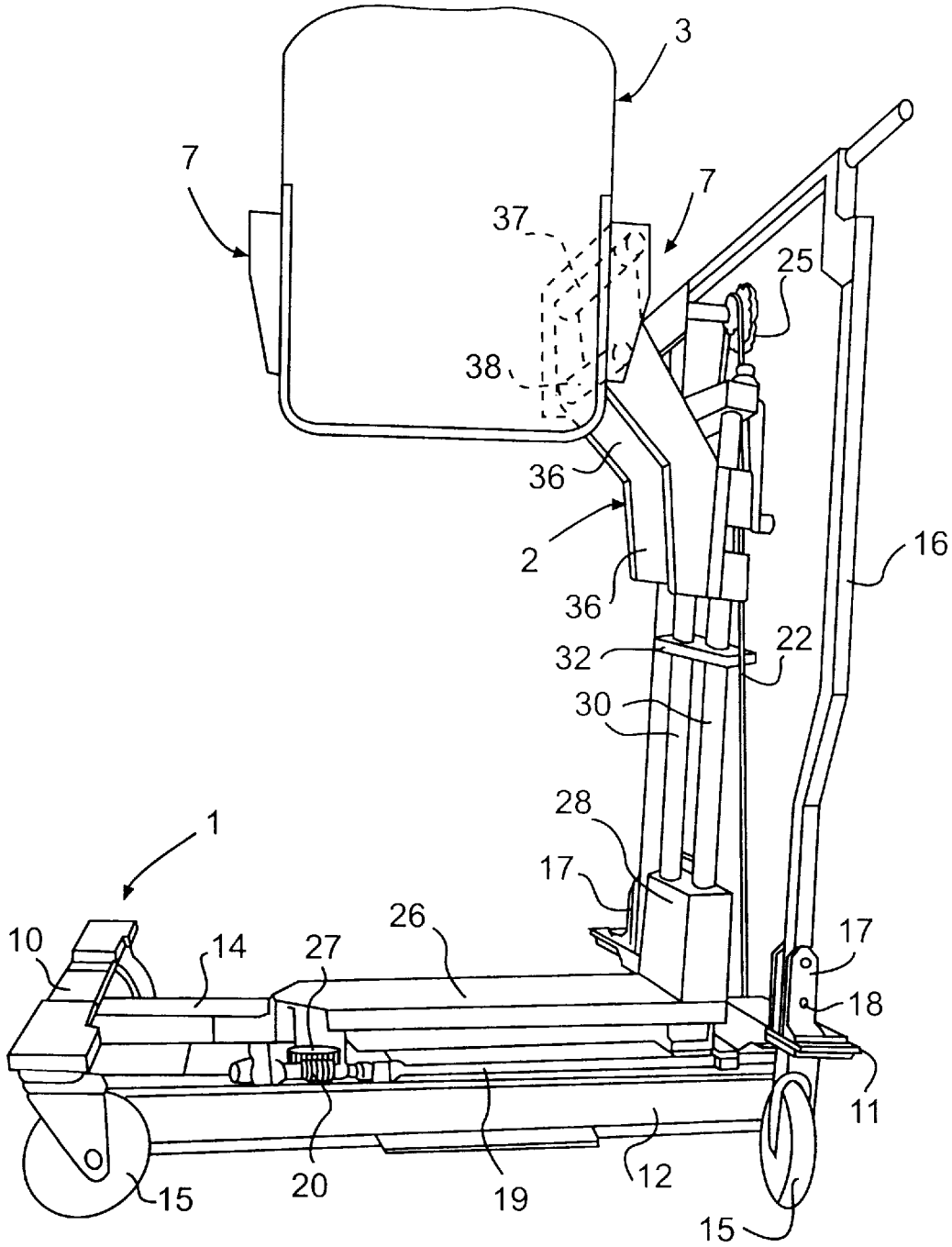
FIG. 1 PRIOR ART
FIG. 1 is a perspective view in side elevation showing a prior art chassis and chair supporting frame with the chair mounted thereon.

With reference now to the drawings in which like numerals represent like elements throughout the views, the prior art wheelchair of U.S. Pat. No. 4,669,943 referenced above will initially be described as the basic construction and operation thereof is broadly similar to that of the present invention. Thus, there is shown in FIGS. 1–4 a prior art wheelchair which is formed of three separable parts, a chassis 1, a chair supporting frame 2, and a chair 3. FIG. 1 shows the three separate sections which make up the wheelchair in the assembled state.

Chair 3 may be formed of a lightweight metal such as aluminum and is provided with armrests 4 and 5 and a manually adjustable footrest 6. On the outside face of armrest 4 there is affixed a support means 7 including a rear plate 8 and a rectangular shaped housing 9 having side walls, end walls and a top wall with an open bottom so as to provide a rectangular shaped recess therein to receive a support bar 37 of the chair supporting frame 2 as will be described more fully hereinafter.

Chassis 1 comprises a frame or supporting platform having a pair of end plates 10 and 11 and cross bars 12, 13 and 14 affixed thereto to form a rigid structure. Casters 15 are mounted on each end of end plates 10 and 11 so as to swivel freely. A U-shaped handle 16 is provided for chassis 1 and handle 16 is pivotally mounted in brackets 17 fixed to end plate 11 as seen in FIG. 1. The pivotal mounting of handle 16 permits the handle to be swung to a position where it is on a plane substantially parallel to the supporting platform of chassis 1. Any suitable locking means such as a removable pin 18 may be provided for securing the handle in its operative position extending vertically with respect to the supporting platform.

There is provided in the supporting platform of chassis 1 a means for rotatably mounting supporting frame 2 on chassis 1. A shaft 19 is mounted for rotation within or upon cross bar 12 of the supporting platform as shown in FIG. 1. A screw thread 20 is provided on one end of shaft 19 and the opposite end of shaft 19 has a gear 21 affixed thereto. A chain drive 22 extends around gear 21, engages gears 23 and 24 mounted on chassis 1 and passes upwardly to a gear and operating wheel 25 rotatably mounted on handle 16. Chain drive 22 may be of any suitable flexible type such as, for example, the nylon and cable Maxiflex timing chain manufactured by Winfred M. Berg. It can be seen that by rotation of operating wheel 25, chain drive 22 drives gear 21 to rotate shaft 19 and screw 20.

Figure 2A:
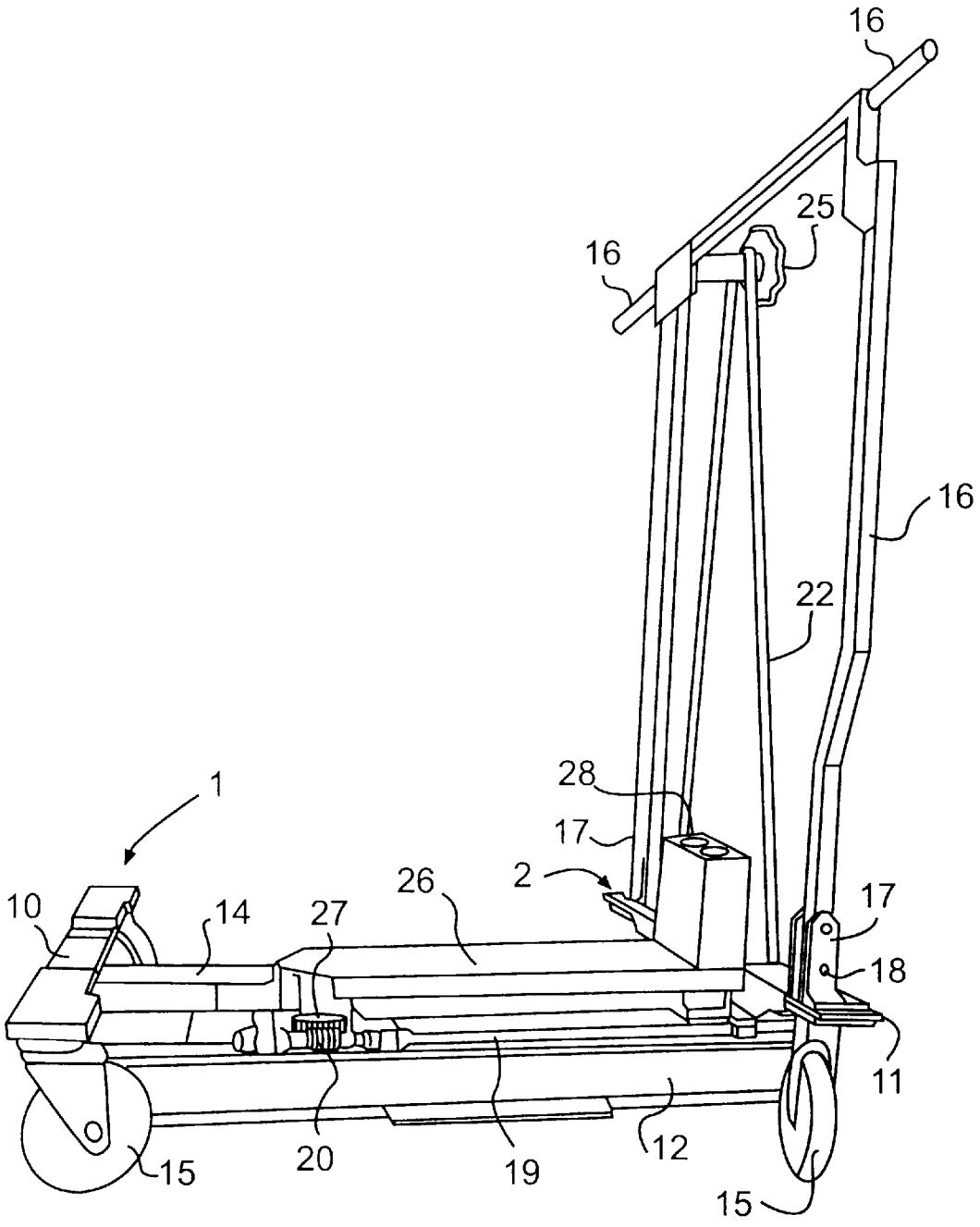
FIG. 2A PRIOR ART
FIGS. 2A, 2B and 2C show a perspective view in side elevation of the three separate elements of the prior art wheelchair of FIG. 1.
Figure 2B:
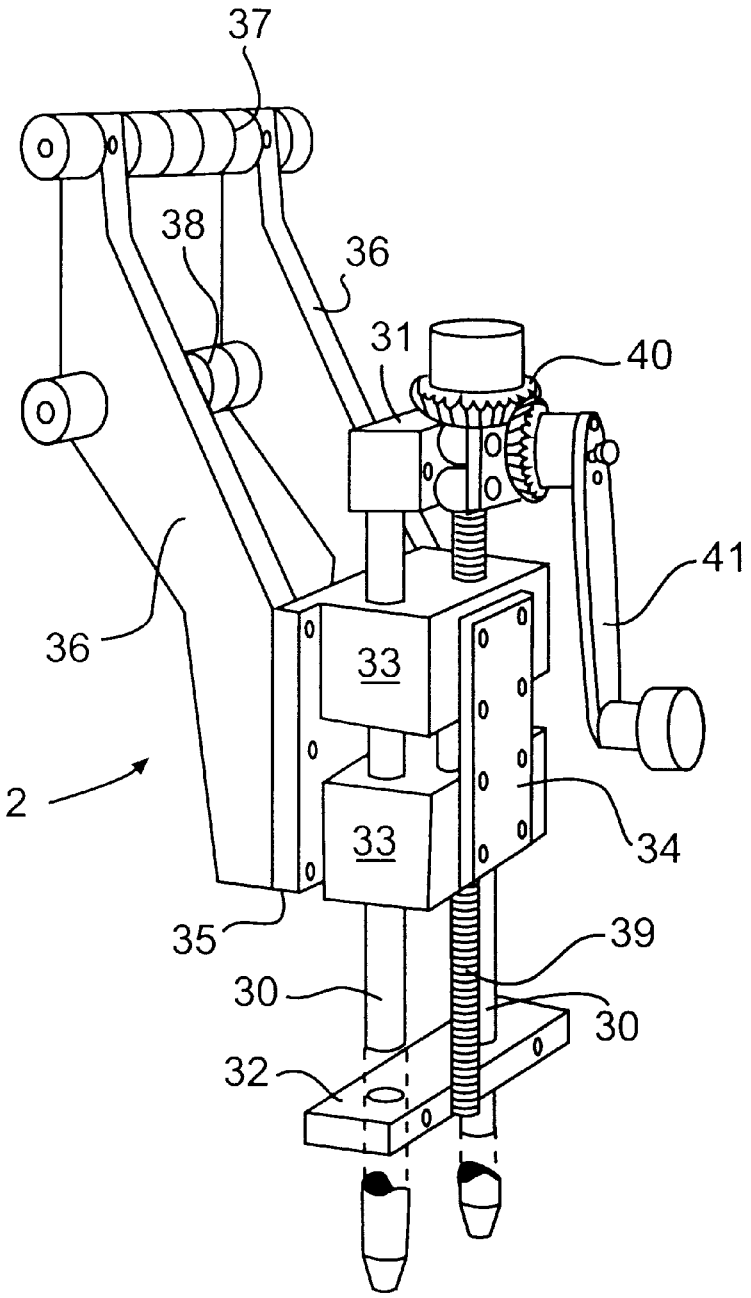
FIG. 2B PRIOR ART
Figure 2C:
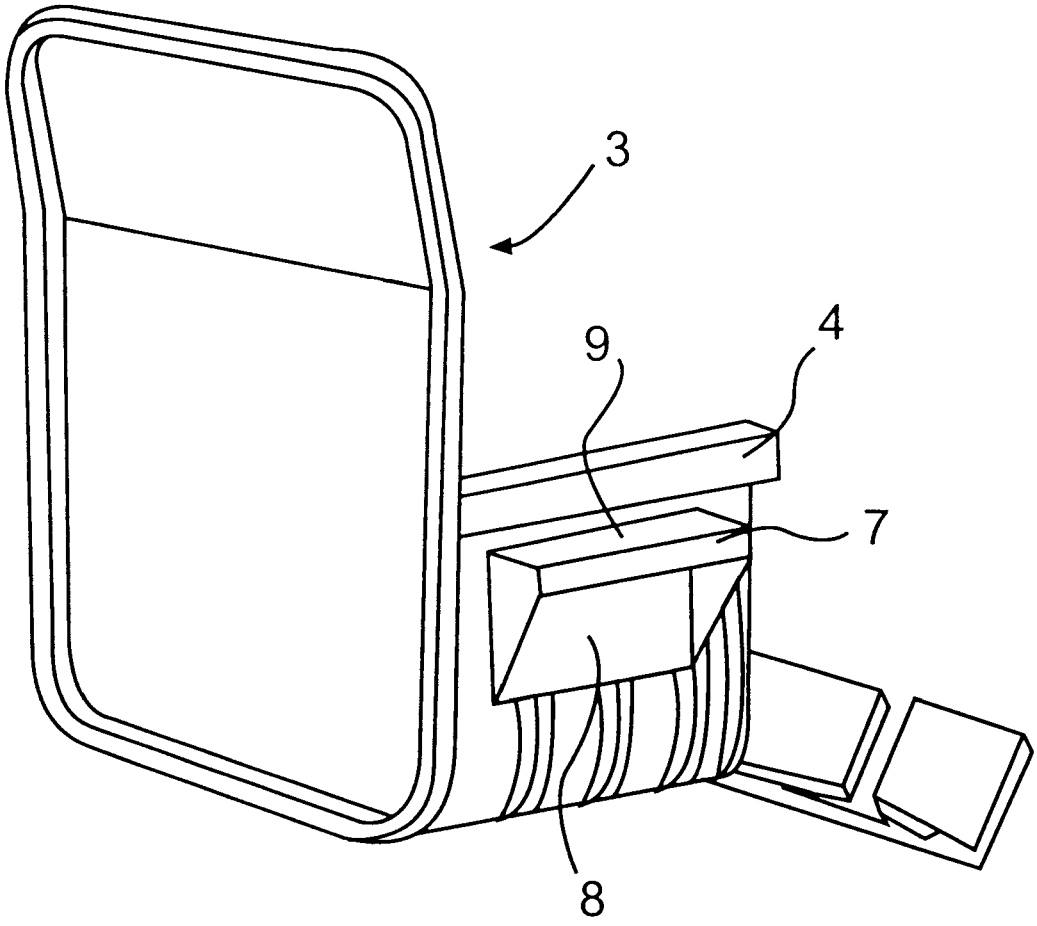
FIG. 2C PRIOR ART

Supporting frame 2 attaches to a generally horizontally extending base member or arm 26 on the lower face of which extends a shaft having a worm gear 27 fixed thereon. The shaft on which worm gear 27 is mounted extends vertically below gear 27 and is journalled in a bearing mounted in the supporting platform of chassis 1. As shown in FIGS. 1 and 2A, in the operative position worm gear 27 engages screw 20 so that rotation of screw 20 causes rotation of worm gear 27 and arm 26.

The outer end of arm 26 has a block 28 permanently mounted thereon by means of welds or bolts. Block 28 has a pair of spaced holes 29 therein to receive a pair of vertically extending tubular rods 30. Tubular rods 30 provide a mounting for the remainder of chair supporting frame 2. Block 28 is fixed to base member 26, and tubular rods 30 are removably supported in holes 29 in block 28 and have tapered ends for easy insertion in holes 29. The upper end of tubular rods 30 are received in bores in an end block 31. There is also provided a stop block 32 which has bores therethrough to receive tubular rods 30 and provide a fixed stop for lowering of chair 3 as will be explained more fully hereinafter.

Chair supporting frame 3 includes upper and lower support blocks 33 which are slidable on tubular rods 30. Face plates 34 and 35 are secured to the outer faces of support blocks 33 to maintain support blocks 33 in precise alignment. Secured to face plate 35 are a pair of outwardly and upwardly extending arms 36, and support bars 37 and 38 are secured in spaced vertical relation to the outer ends of arms 36. Support bars 37 and 38 support chair 3 as shown. Upper support bar 37 fits within the recess formed inside housing 9 of support means 7 secured to the side of chair 3. Lower support bar 38 abuts rear plate 8 of support means 7.

The manually operated means for raising and lowering chair 3 is shown in FIG. 1. Rotatably mounted within end block 31 is a vertically disposed screw 39 having a bevel gear 40 fixed to the upper end thereof. A crank arm 41 having a mating bevel gear fixed thereto is journalled in end block 31. Upper and lower support blocks 33 have apertures therein to receive screw 39. Nuts are fixed within support blocks 33 so that rotation of screw 39 will raise or lower support blocks 33 between end block 31 and the stop block 32.

Figure 3:
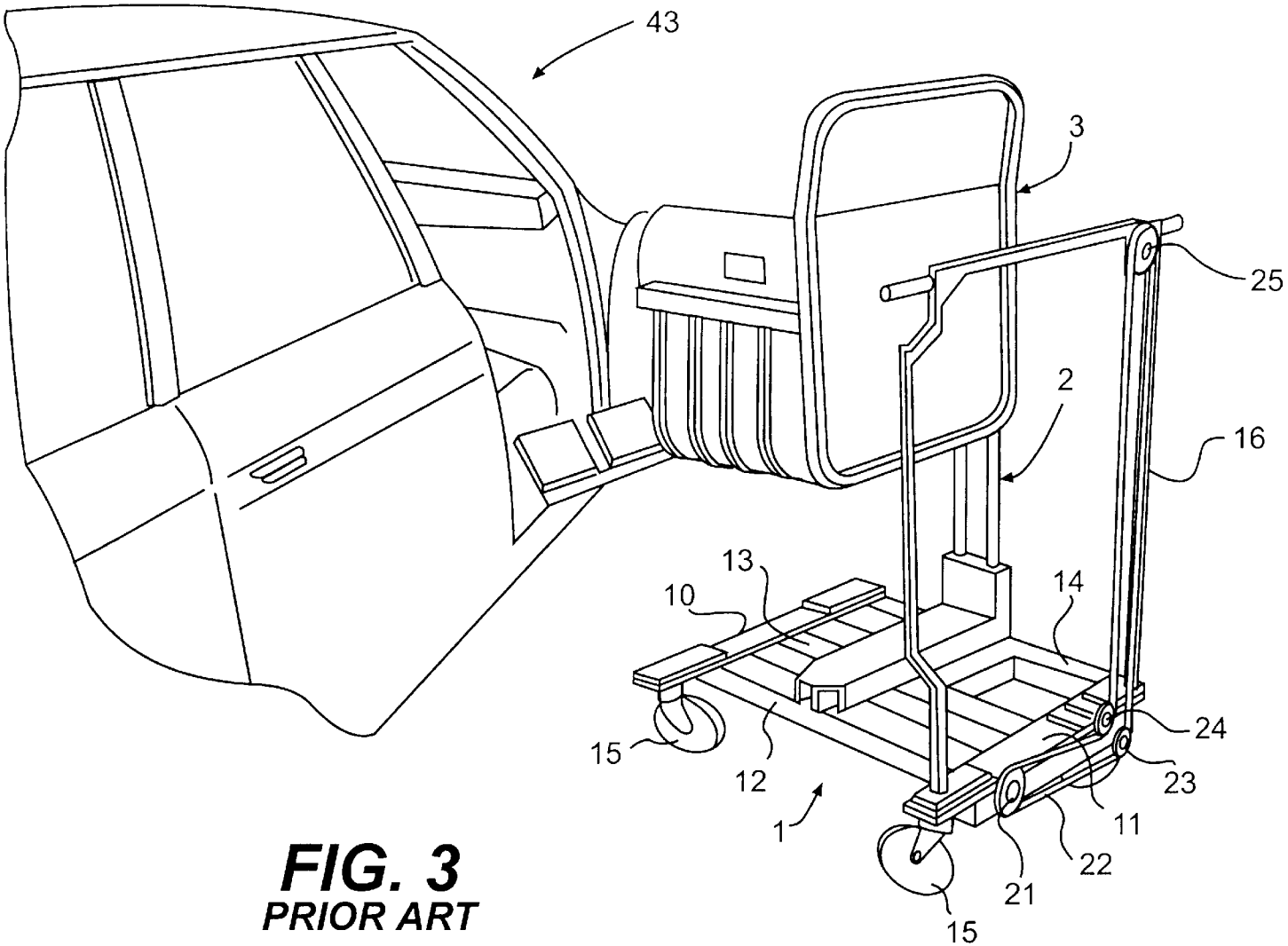
FIG. 3 PRIOR ART
FIG. 3 is a perspective view in side elevation showing the prior art wheelchair in a position for movement of the chair into an automobile.
Figure 4:
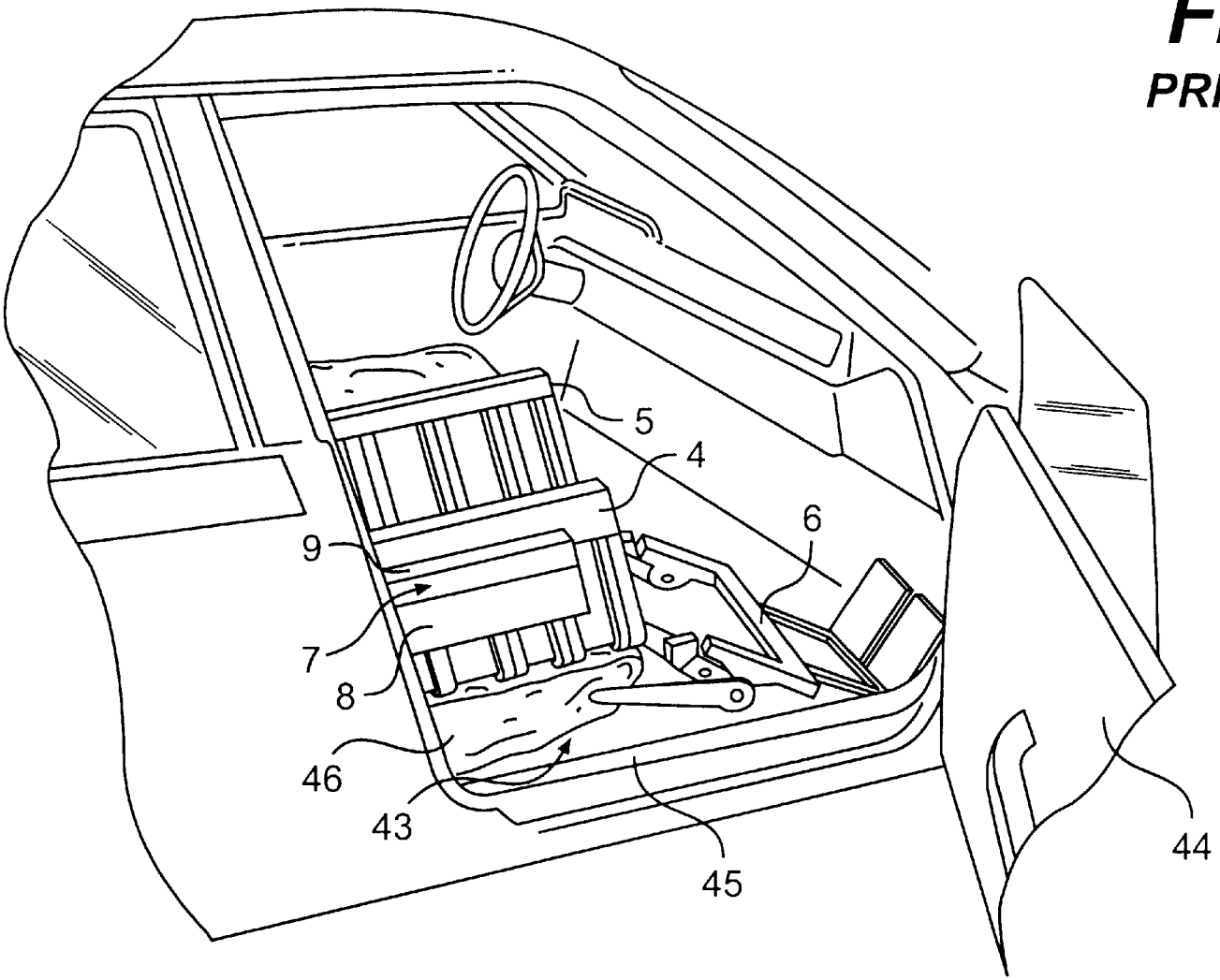
FIG. 4 PRIOR ART
FIG. 4 is a perspective view in side elevation showing the prior art wheelchair removed from the wheeled chassis and resting on the seat of an automobile.

In use of this prior art wheelchair, a handicapped person may be seated in chair 3 and transported by someone grasping handle 16 and pushing chair 3 which may be centrally located over the supporting platform of chassis 1. When it is desired to transfer the person to an automobile through a door opening 43 thereof, a door 44 of the car is opened and chair 3 is directed into door opening 43 as shown in FIG. 3. Footrests 6 are also hinged at their point of attachment to chair 3 so that they can be manually raised to clear car door sill 45 and then manually re-lowered to rest on the floor. Chassis 1 is directed towards door opening 43 at substantially the same angle as opened door 44 so that chair 3 is positioned over car seat 46 angularly. In this position a portion of chassis 1 is disposed beneath the car. Operating wheel 25 is then rotated to rotate arm 26 with respect to chassis 1. Arm 26 is rotated until chair 3 is turned so that the chair back is aligned with the car seat back. Crank arm 41 may then be rotated to lower chair 3 to rest on car seat 46. Continued rotation of crank arm 41 causes upper support bar 37 to be withdrawn from the recess formed inside housing 9 of support means 7 on chair 3 so as to disengage chair 3 from the remainder of the wheelchair. Chassis 1 and chair supporting frame 2 may then be separated from each other and handle 16 folded for storage.

While the above described prior art wheelchair performs satisfactorily, there are a number of disadvantages thereof which the present wheelchair system is designed to overcome. Thus, an improved wheelchair system 49 according to the present invention is depicted in FIGS. 5–11. It will be appreciated that the same identifying numbers are used to identify similar elements in wheelchair system 49 as were used above with respect to the prior art wheelchair, and that such similar elements are not further discussed in detail except where differences are significant.

Figure 5:
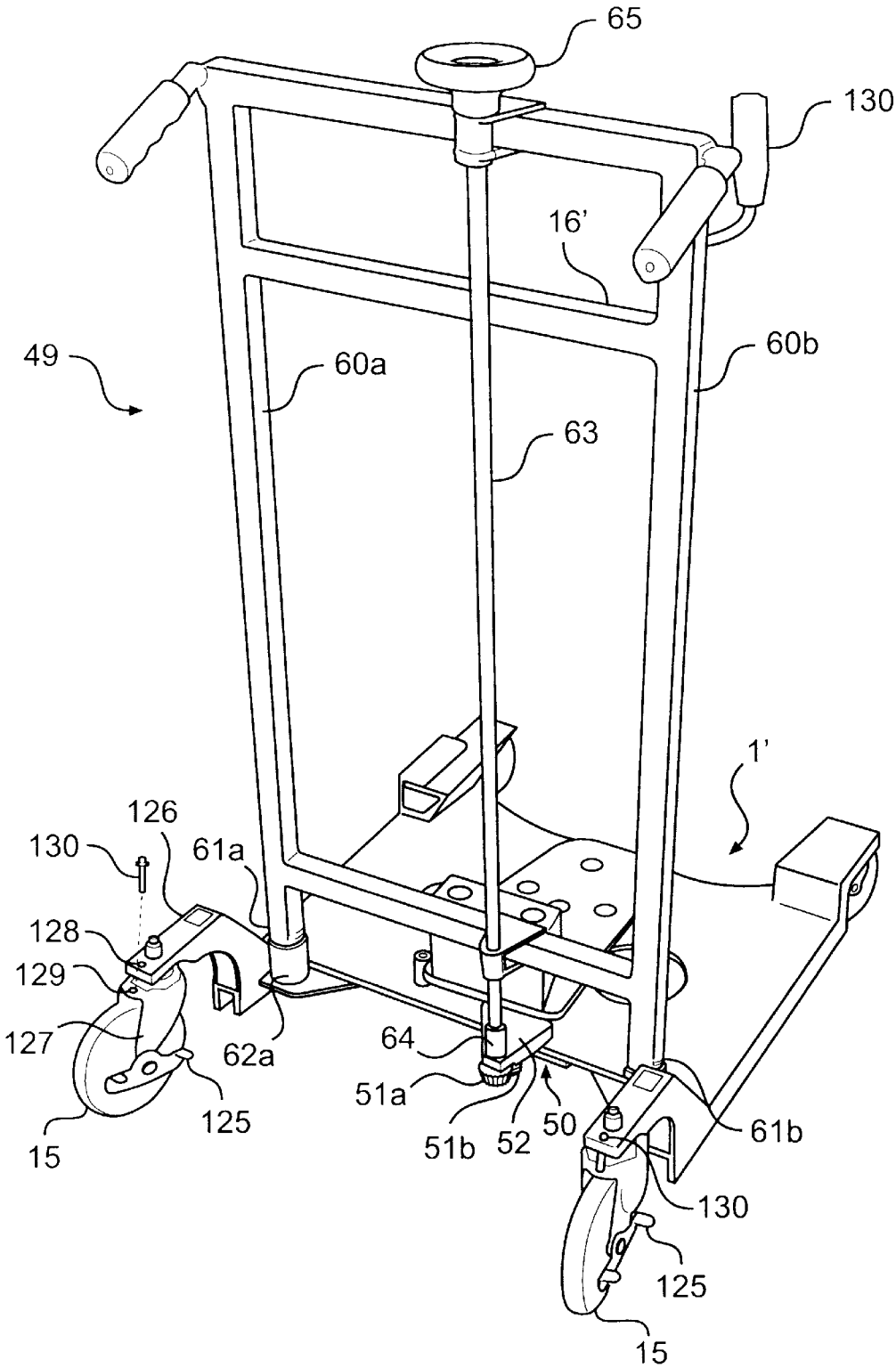
FIG. 5 is a rear, top and right side perspective view of an improved chassis and handle assembly of the wheelchair system of the present invention.
Figure 6:
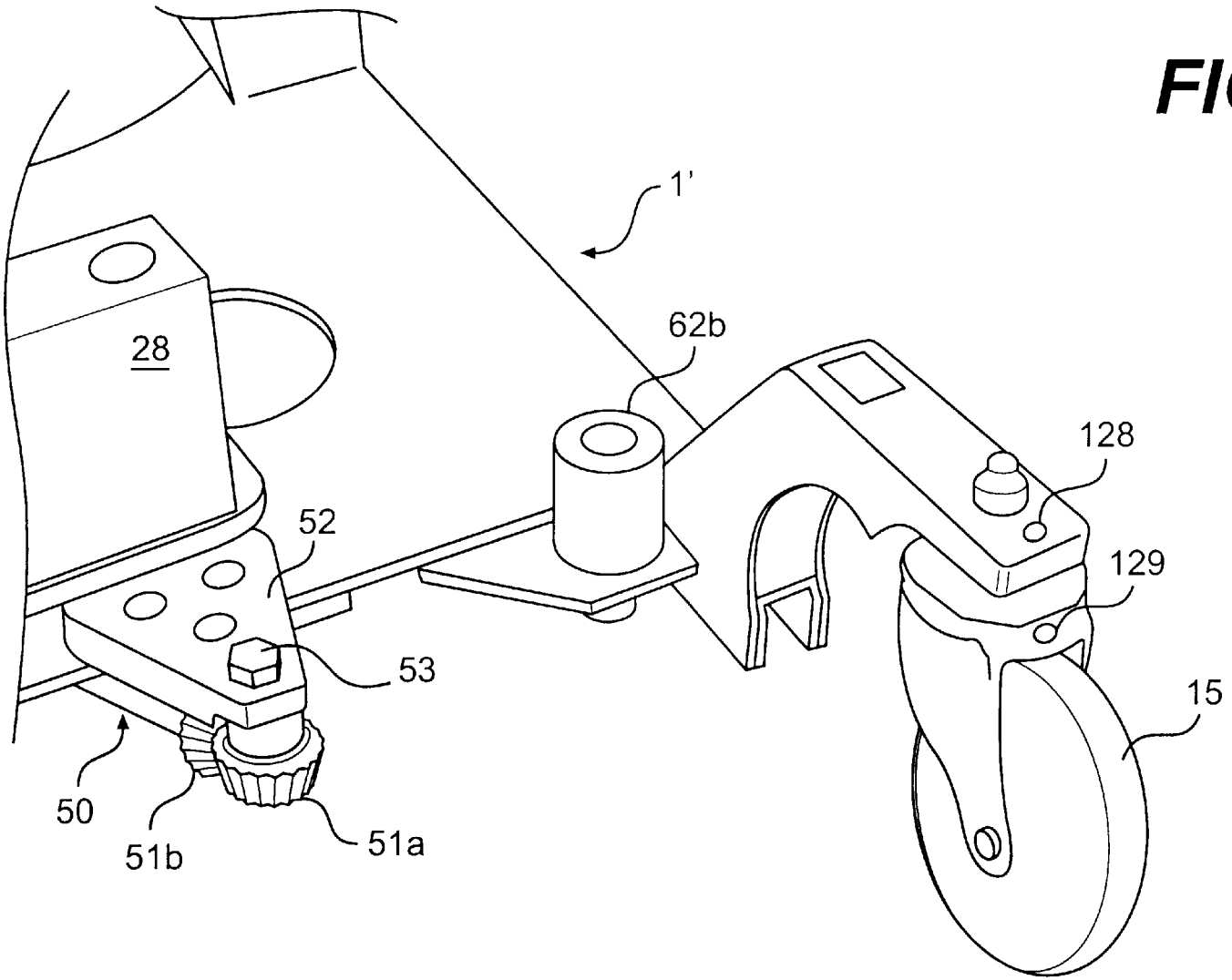
FIG. 6 is a rear, top and left side perspective view of a portion of the chassis depicted in FIG. 5 with the handle assembly removed.
Figure 8:
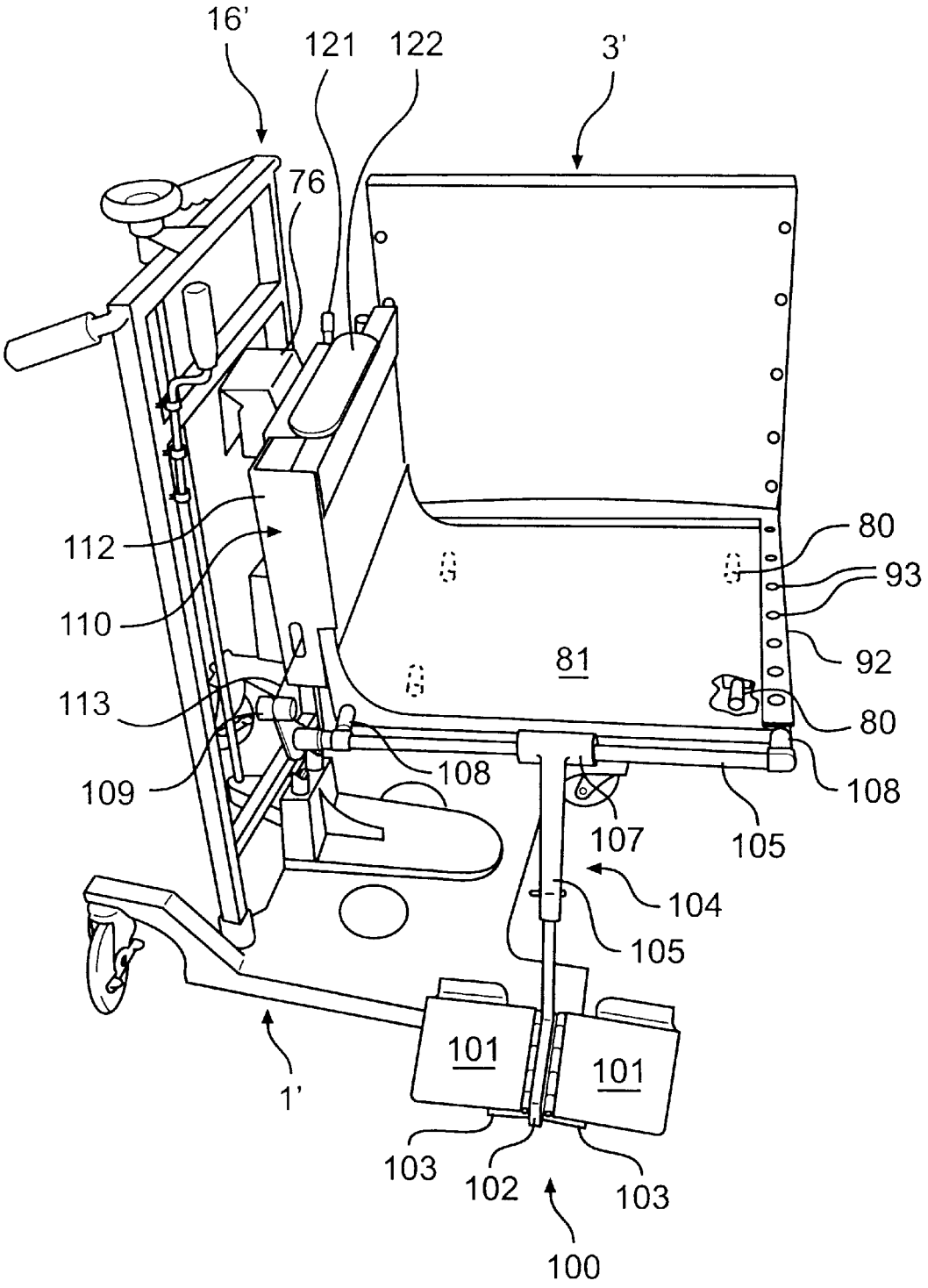
FIG. 8 is a top, front and right side perspective view of the wheelchair of the present invention.
Figure 9:
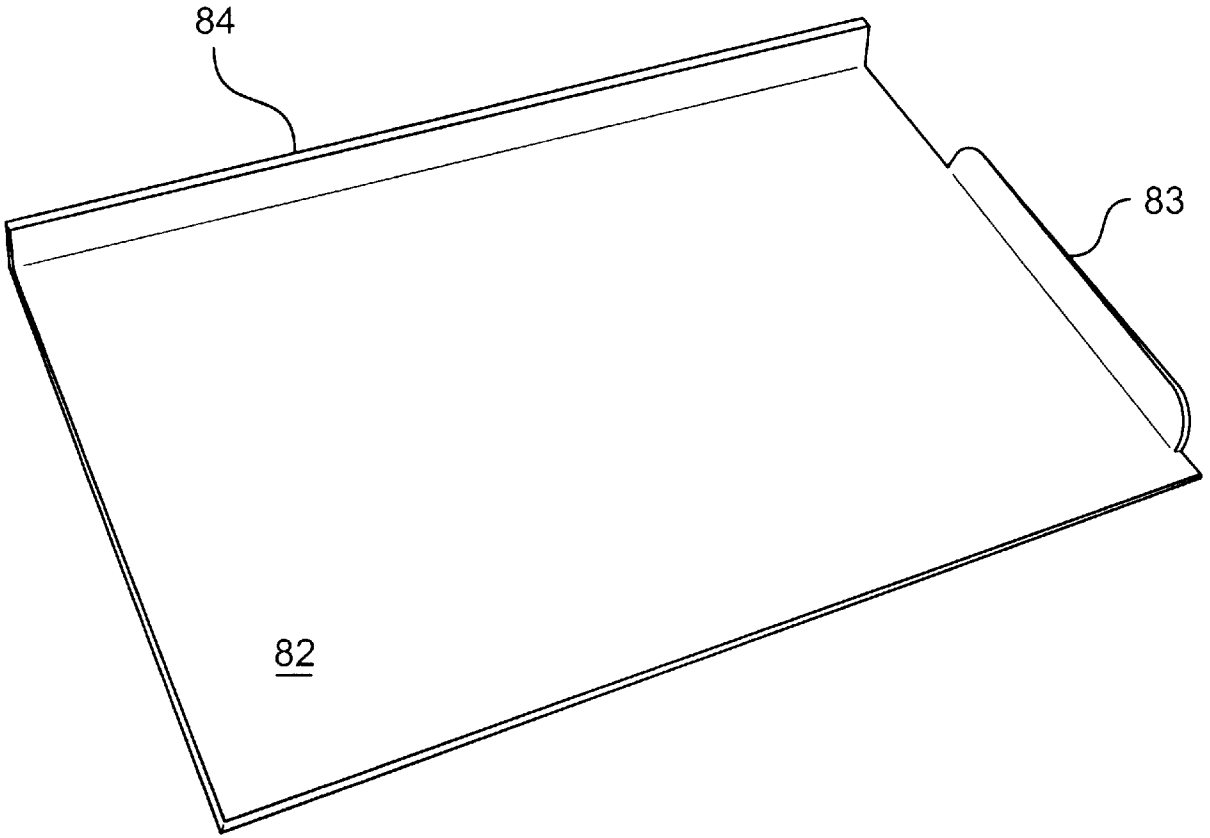
FIG. 9 is a top, front and right side perspective view of a chair plate of the wheelchair system of the present invention.

As shown particularly in FIGS. 5–6 and 8, an improved chassis 1' is provided with a removable handle assembly 16' and a simplified rotatable actuating linkage 50 by which base member 26 is rotated. Actuating linkage 50 includes a pair of bevel gears 51*a* and 51*b* at the rear end of chassis 1' in place of gear 21 of chassis 1. Bevel gears 51 are rotatably mounted on a bracket 52 extending from chassis 1', with the upper bevel gear 51*a* being rotatable by a driven member 53 located at the top of bracket 52. Conveniently, driven member 53 takes the form of hex nut or the like.

Removable handle assembly 16' includes paired vertically extending support bars 60*a* and 60*b* as shown in FIG. 5. Each support bar 60 has a respective free distal end 61*a* and 61*b*. Distal ends 61*a* and 61*b* are removably mounted in chassis 1' by use of a suitable handle mounting means. In this preferred embodiment, the handle mounting means comprises paired vertical support brackets 62*a* and 62*b* integrally formed with chassis 1' at a rear portion thereof. Support brackets 62 have a vertically extending bore open at the top in which respective ones of rounded distal ends 61 of handle assembly 16' are slidably received with only a little play. Thus, distal ends 61 are easily vertically removed from and inserted into brackets 62, but handle assembly 16' is otherwise securely held in place when used to push wheelchair assembly 49.

Mounted between support bars 60 by suitable brackets is a base member drive linkage 63 which is used for rotating driven member 53 of actuating linkage 50. Linkage 63 includes a removable driving member 64 which is positioned to removably connect/disconnect to driven member 53 as distal ends 61 are received/withdrawn in the bores of brackets 62 to connect/disconnect handle assembly 16' to/from chassis 1'. Conveniently, driving member 64 is a hex socket located at the bottom end of linkage 63 which removably fits over driven member 53 where driven member 53 is a hex nut. At the upper end, adjacent a top of handle assembly 16', linkage 63 includes a driven member, which in this preferred embodiment takes the form of a turning wheel 65 which is easily turned by hand to result in movement of base member 26. With the use of removable handle assembly 16', when chair 3 is separated from chair supporting frame 2 and it is desired to stow the remainder of wheelchair assembly 49, not only can chair supporting frame 2 be separated from chassis 1' for easy stowage, but additionally handle assembly 16' can be separated from chassis 1' to further lighten chassis 1' for easy stowage. Stowage of chassis 1' is also made more easy by not having handle 16 attached thereto and extending horizontally therealong, as handle assembly 16' can now be stowed separately from chassis 1'.

Figure 7:
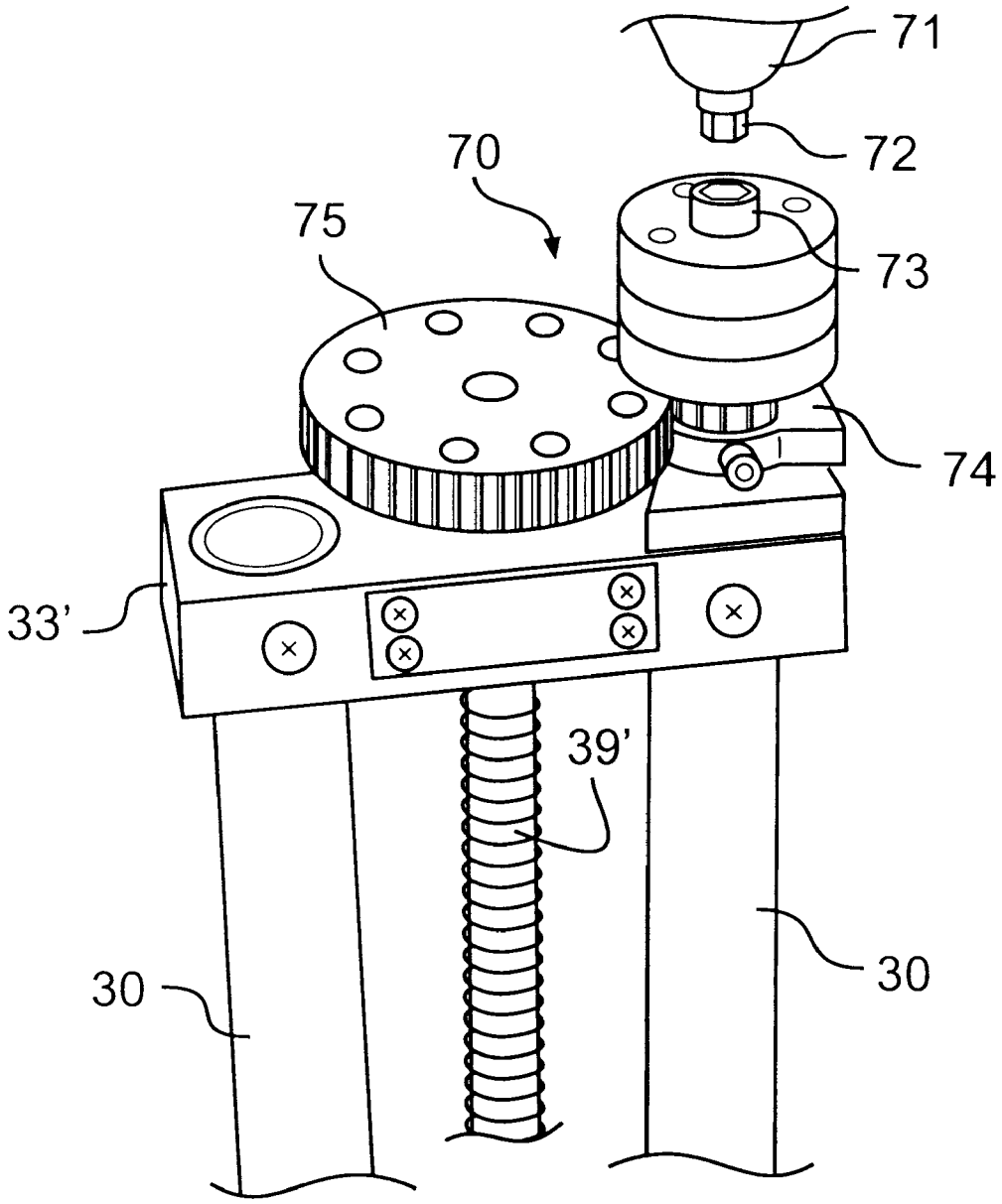
FIG. 7 is a top and rear perspective view of a top portion of the chair vertical adjusting means of the present invention.

Wheelchair system 49 also includes an improved adjusting means 70 for the vertical position of chair 3' relative to chassis 1' as shown in FIG. 7. Adjusting means 70 includes a portable electric power source conveniently in the form of a hand-held electric driver 71, such as a rechargeable battery driven drill or the like well known in the art. Driver 71 is thus relatively light-weight and also easily stowed until needed, and conveniently also includes a conventional charging device and spare battery (not shown). Extending from the nose or rotating tip of driver 71 is a suitable driving tool 72 such as a conventional male hex member by which vertical movement of chair 3' is effected without physical exertion by the operator of wheelchair system 49.

Adjusting means 70 also includes an actuation member 73 which is turned by driving tool 72 removably received therein. As shown in FIG. 7, actuation member 73 is preferably a simple hex socket attached to a small spur gear 74 mounted for rotation on upper support block 33'. Small spur gear 74 engages a large spur gear 75 mounted at an upper end to a main drive screw 39' journalled for rotation in upper support block 33'. With this construction, it will be appreciated that the vertical position of chair 3' is easily changed by use of driving tool 72 after engagement of driving tool 72 in actuation member 73. For safety, as shown in FIG. 8, spur gears 74 and 75 are covered by a cover 76, leaving only actuation member 73 exposed. It will also be appreciated that turning wheel 65 could be replaced with a similar actuation member and spur gears so that rotation of base member 26 could be effected by driving tool 72 as well.

In order to facilitate movement of the chair in and out of the automobile, wheelchair system 49 includes a modified chair 3'. Chair 3', as shown in FIG. 8, includes four rollers 80 mounted on the bottom thereof; one roller 80 is shown in a broken away portion of seat 81 of chair 3', while the other three are schematically shown in phantom for convenience. Rollers 80 have rotation axes which extend from the front to the back of chair 3', so that chair 3' easily rolls left or right (sideways).

For use with rollers 80, wheelchair system 49 also includes a chair plate 82. Chair plate 82 is made of a suitable hard material, such as a light metal or hard plastic. In use, chair plate 82 is placed on the seat 46 of the automobile prior to moving chair 3' into door opening 43. Then, as chair 3' is maneuvered into position in door opening 43, rollers 80 engage chair plate 82 as chair 3' is lowered. This rolling engagement makes it easier to further fine position chair 3' on seat 46 should the position of chair 3' not be exactly as desired as chair 3' is lowered onto seat 46. Without the use of chair plate 82, the repositioning of chair 3' would require raising of chair 3' again or a hard rubbing against the seat 46 (if movement is even possible without raising chair 3'), which hard rubbing be even more difficult due to the rolls or the like typically found on car seats. It will be appreciated that chair plate 82 also reduces wear on seat 46 occasioned by the hard surface of chair 3'.

In order to assist in positioning chair 3' properly on car seat 46, and additionally to prevent chair 3' from rolling too far into the automobile, chair plate 82 includes a side ledge 83 on the inside (in this case, left side) thereof. In addition, to help position chair 3' thereon, and to prevent chair plate 82 from sliding into the joint between the sitting part and back part of car seat 46, chair plate 82 also includes a back ledge 84. If desired, back ledge 84 can be extended upwards a foot or more and thus provide protection for the car seat back from the hard back of chair 3'. Chair plate 82 is designed to be relatively lightweight, so that it can be easily moved and stowed like the remainder of the stowed elements of wheelchair system 49. It will be appreciated that chair plate 82 is useful even where chair 3' is not provided with rollers 80.

Figure 10:
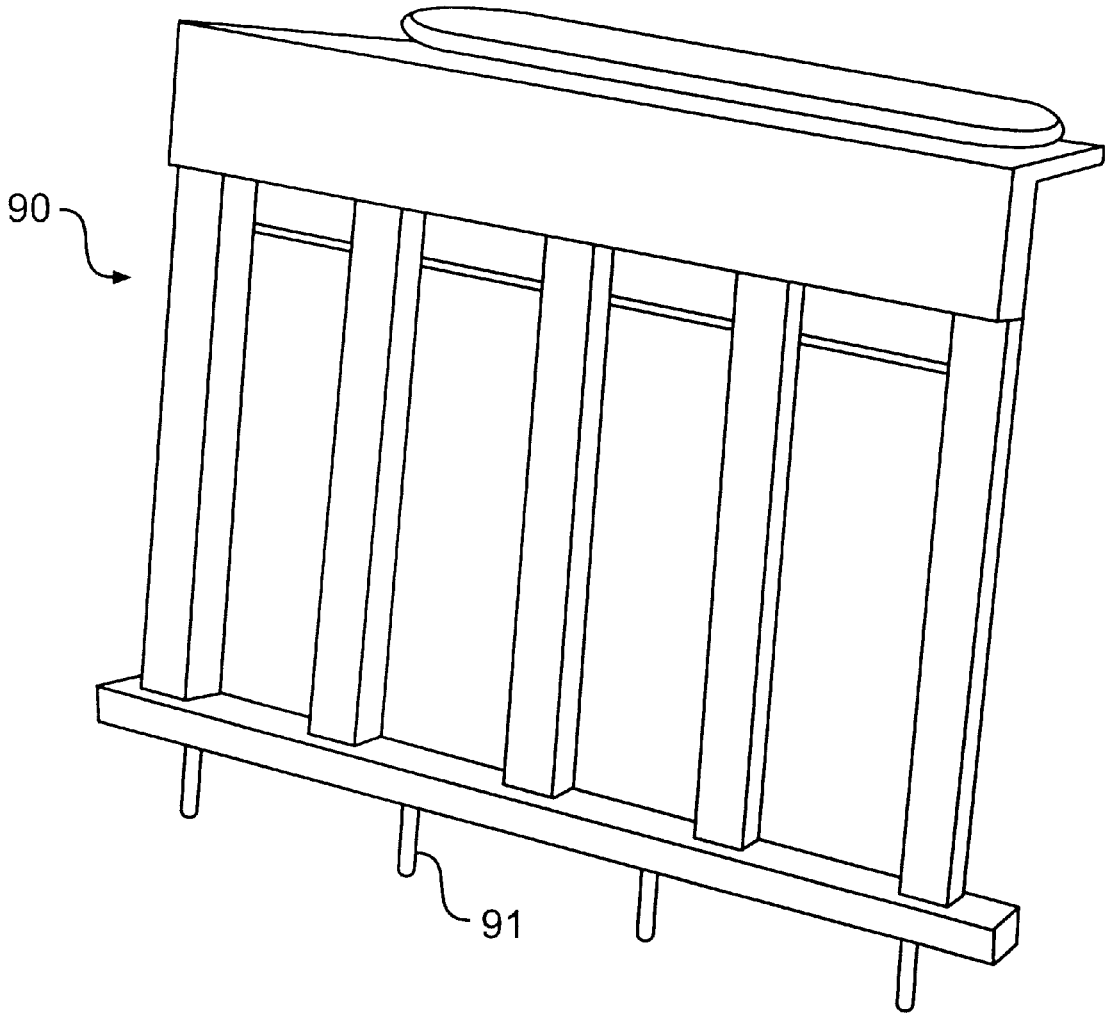
FIG. 10 is a top, front and right side view of a detachable left side of the chair.
Figure 11:
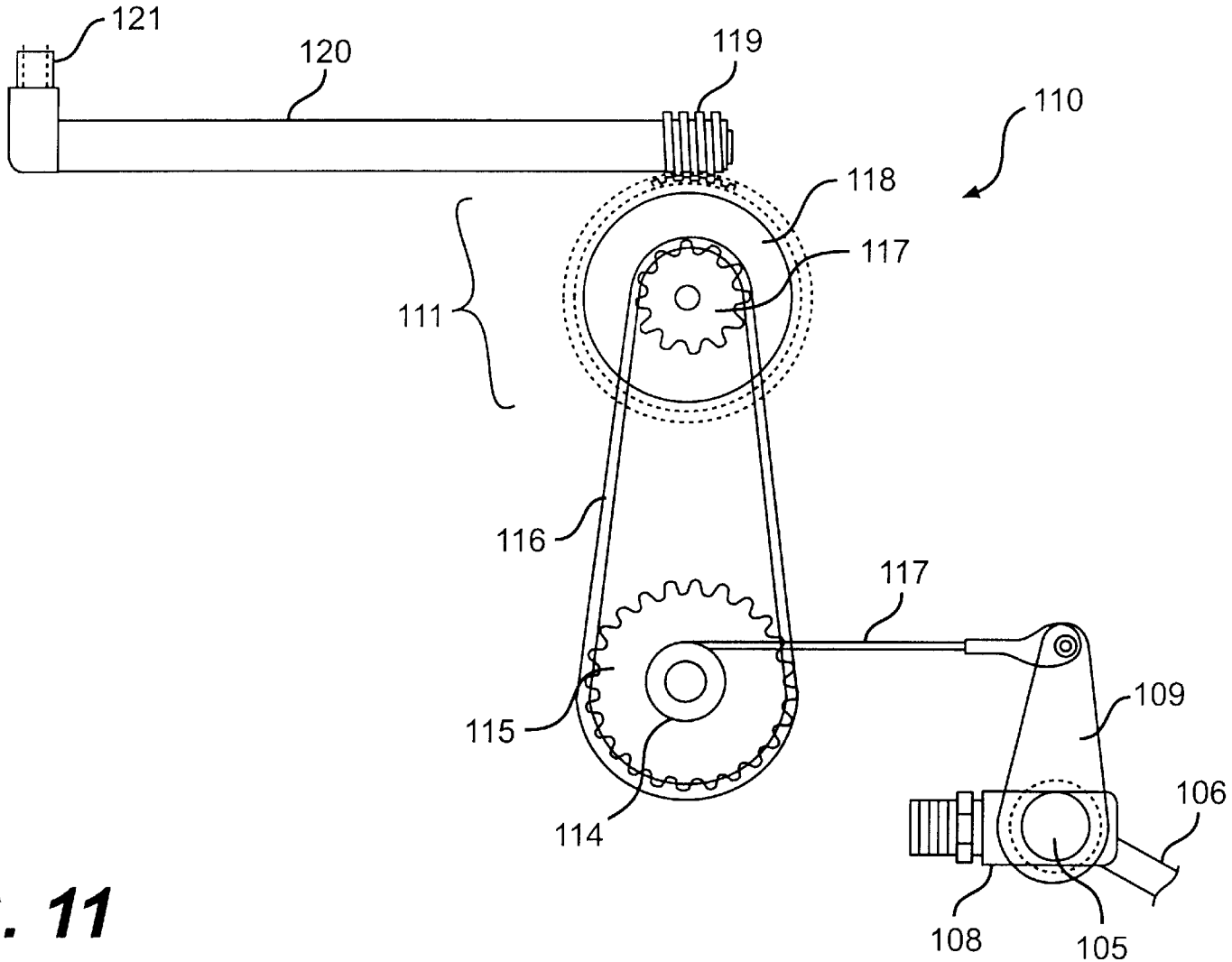
FIG. 11 is schematic right side view of a foot rest adjusting mechanism.

Chair 3' preferably includes a removable left side 90 as depicted in the detached state in FIG. 10. Left side 90 includes a plurality of depending stub shafts 91. Provided in a left side frame member 92 of seat 81, as depicted in FIG. 8, is a corresponding plurality of vertical holes 93 in which respective ones of stub shafts 91 are slidably received. Left side 90 is thus securely held on seat 81, but is removable by lifting up thereon for various reasons as desired. For example, once chair 3' is position on car seat 46, it may be desirable to remove left side 90 to facilitate use of the car seat belt. In addition, when transferring the user from a bed or the like, it is much easier to slide the user from the bed onto seat 81 with left side 90 removed once seat 81 is adjusted to the height of the bed.

Wheelchair system 49 also includes a foot rest 100 as best shown in FIG. 8. Foot rest 100 includes two foot rest plates 101 that are hinged at their inside edges to a central post 102. Stops 103 are mounted to central post 102 to maintain plates 101 in the use position depicted in FIG. 8, with plates 101 thus being movable to an upright position when it is desired to reduce the profile of rest plates 101. Central post 102 is mounted to chair 3' by a foot rest mounting means 104 so that foot rest 100 is movable along the mounting angle thereof. Mounting means 104 includes a mounting bar 105 mounted horizontally for rotation about a horizontal axis in front of seat 81 of chair 3'. A single adjustable length telescoping arm 106 then connects central post 102 to mounting bar 105 at a joint 107. As shown, mounting bar 105 is rotatably held at each side of seat 81 by mounting brackets 108. Attached to the right side of mounting bar 105 and extending perpendicular thereto is a lever 109.

Foot rest 100 is incrementally adjusted and held in position vertically relative to chair 3' from a position remote from foot rest 100 by use of a remote foot rest adjustment means 110. With foot rest adjustment means 110, the legs of the person seated in chair 3' are easily moved out of the way of the automobile as chair 3' is positioned through automobile door opening 43 and onto car seat 46 as required. Adjustment means 110 includes a linkage 111 connected to lever 109 as shown on FIG. 11. Adjustment means 110 is mounted to the right side of chair 3' and preferably includes a cover 112 therefor to prevent harm to a user or occupant of wheelchair system 49.

In this preferred embodiment, linkage 111 includes a flexible cord 113 or the like which is connected to the free end of lever 109. Cord 113 is connected at the other end to a spool 114 about which cord 113 is wound/unwound to adjust the position of lever 113 and hence the vertical position of foot rest 100, or about which cord 113 is held stationary to hold foot rest 100 in a desired vertical position. Spool 114 is attached to a driven sprocket 115 which is connected by a chain 116 to a drive sprocket 117. Drive sprocket 117 is in turn connected coaxially to a worm gear 118 turned by a worm 119 provided on a shrouded drive axle 120. Finally thread 119 is rotated by movement of a driven member 121 provided at right angles to the drive axle. Driven member 121 is conveniently provided with a hex socket the same as actuation member 73 so that driven member 121 is also easily driven by driving tool 72 of electric driver 71. It will be appreciated that driven member 121 is located remote from foot rest 100, such as at the preferred position adjacent the outside (relative to the car door opening 43) armrest 122 of chair 3', so as to be out of the way when adjustment of foot rest 100 takes place which is particularly important when chair 3' is located in door opening 43 as there may be little room adjacent foot rest 100.

Chassis 1' is also provided with brake levers 125 provided on the rear ones of casters 15. With brake levers 125, rear casters 15 are easily locked in place by toe pressure of the operator to prevent movement of wheelchair system 49. In addition, mounting bracket 126 of chassis 1' and caster bracket 127 of rear caster 15 each have a receiving hole 128 and 129 respectively therein which are vertically aligned when rear caster 15 is positioned in a straight forward orientation. Thus, when it is desired to maintain rear casters 15 in a straight forward orientation, as where wheelchair system 49 is used like a regular wheelchair, a removable pin 130 is passed through holes 128 and 129 to lock rear casters 15 in the straight forward position.

It will be noted that chassis 1' is provided as a base plate with a plurality of holes therein, and that base member 26' is similarly holed. These holes serve to make chassis 1' lighter in weight, without compromising strength. Similarly, the other elements of wheelchair system 49 are designed for suitable strength, while being relatively lightweight for easy handling.

It will also be noted that a manual driver 130 may be provided on handle 16' having an offset driving tool substantially the same as driving tool 72 in case electric driver 71 is not available.

While the present invention has been described with respect to exemplary embodiments thereof, it will be understood by those of ordinary skill in the art that ions and modifications can be effected within the scope and spirit of the invention.

I claim:

1. A wheelchair system for supporting a handicapped person and for transferring the handicapped person in the wheelchair through an automobile door opening and onto an automobile seat, said wheelchair system comprising:

a wheeled chassis having front and rear ends and being of a height to permit the front end of said chassis to be rolled beneath an automobile door opening, said wheeled chassis including a horizontally extending base member, and a rotatable mounting means for rotatably mounting a front end of said base member to the front end of said chassis for rotation about a vertical axis, said rotatable mounting means including a first actuating linkage by which said base member is rotated and a first driven member at an end of said first actuating linkage by which said first actuating linkage is rotated to incrementally rotate said base member;

a chair supporting frame located centrally of said chassis and removably mounted on a rear end of said base member, said chair supporting frame including a vertically extending support member, and an adjusting means for vertically adjusting a position of said support member with respect to said base member;

a handle assembly removably mounted to the rear end of said chassis, said handle assembly including a second linkage for rotating said first driven member of said rotatable mounting means, said second linkage including a removable driving member which removably connects to said first driven member of said rotatable member as said handle is removed and connected to said chassis, and a second driven member at an end of said second linkage opposite to said removable driving member;

a chair in which a handicapped person sits, said chair including a detachable left side so as to facilitate use of a seat belt by the person seated in said chair when in the automobile;

a removable mounting means for removably mounting said chair in a cantilevered manner on an upper end of said vertically extending support member in vertical spaced relation to said wheeled chassis and in a position substantially overlying a length of said base member, whereby when said chassis is rolled beneath an automobile door opening, said chair will be positioned over the automobile seat, when said chair is positioned over an automobile seat, said chair may be lowered onto the automobile seat and said chair supporting frame may be disconnected from said chair, and when said chair is separated from said chair supporting frame and said chassis said chair supporting frame, said chassis and said handle assembly may be separated from one another for easy carrying and stowage.

2. A wheelchair system as claimed in claim 1:

wherein said handle assembly includes a pair of vertically extending support bars with free distal ends between which said second linkage is mounted; and wherein said chassis includes a handle mounting means for removably mounting said handle assembly to said chassis, said handle mounting means including a pair of vertical support brackets having holes in which respective ones of said distal ends of said handle support bars are received.

3. A wheelchair system as claimed in claim 1:

wherein said adjusting means includes an actuation member which is rotated to cause the position of said chair to move vertically, and a portable electric driver having a driving tool which removably connects with said actuation member to rotate said actuation member, which said portable electric driver is also easily carried and stowed.

4. A wheelchair system as claimed in claim 1:

wherein said second driven member is a manual turning wheel located at a top of said handle assembly by which said removable driving member of said second linkage is easily rotated to cause said base member and hence said chair mounted thereon to rotate.

5. A wheelchair system as claimed in claim 1:

wherein said chair includes rollers on a bottom thereof mounted for allowing said chair to easily roll sideways; and further comprising a chair plate which is placed on the automobile seat and which is engaged by said rollers of said chair so as to facilitate movement of said chair into and out of the automobile.

6. A wheelchair system as claimed in claim 1:

wherein said chair includes a left side frame member extending horizontally having a plurality of vertical holes therein; and wherein said detachable left side includes a plurality of stub shafts extending vertically downwards therefrom which are removably received in respective ones of said plurality of vertical holes of said left side frame member in order to detachably mount said left side to said left side frame member.

7. A wheelchair system as claimed in claim 1, further comprising:

a foot rest;

a foot rest mounting means for mounting said foot rest to said chair for movement in a vertical plane; and a remote foot rest adjustment means for incrementally adjusting and holding said foot rest vertically relative to said chair from a position remote from said foot rest whereby legs of the person are easily moved out of the way of the automobile as the chair is positioned through the automobile door opening and onto the automobile seat.

8. A wheelchair system as claimed in claim 7:

wherein said foot rest mounting means includes a mounting bar mounted horizontally for rotation at a front of a seat of said chair and to which said foot rest is attached and a lever attached to one end of said mounting bar; and wherein said remote foot rest adjustment means includes a third linkage connected to said lever, a third driven member located remote from said foot rest which is rotated to activate said third linkage and hence to move said lever and the associated said mounting bar incrementally for adjustment and holding of said foot rest, and a portable electric driver having a driving tool which removably connects with said third driven member to rotate said third driven member, which said portable electric driver is also easily carried and stowed.

9. A wheelchair system as claimed in claim 8:

wherein said remote foot rest adjustment means is mounted to said chair; and wherein said third driven member is located adjacent an armrest of said chair.

10. A wheelchair as claimed in claim 9:

wherein said third linkage includes a flexible cord attached at one end to said lever and a spool to which the other end of said flexible cord is attached and about which said flexible cord is wound to adjust and hold said foot rest.

11. A wheelchair system as claimed in claim 10:

wherein said foot rest mounting means further includes a single mounting arm extending from said mounting bar to said foot rest.

12. A wheelchair system as claimed in claim 8:

wherein said adjusting means includes an actuation member which is rotated to cause the position of said chair to move vertically; and wherein said driving tool of portable electric driver also removably connects with said actuation member to rotate said actuation member.

13. A wheelchair system as claimed in claim 12:

wherein said chair includes rollers on a bottom thereof mounted for allowing said chair to easily roll sideways; and further comprising a chair plate which is placed on the automobile seat and which is engaged by said rollers of said chair so as to facilitate movement of said chair into and out of the automobile.

14. A wheelchair system as claimed in claim 13:

wherein said chair includes a detachable left side so as to facilitate use of a seat belt by the person seated in said chair when in the automobile.

15. A wheelchair system as claimed in claim 14:

wherein said chair includes a left side frame member extending horizontally having a plurality of vertical holes therein; and wherein said detachable left side includes a plurality of stub shafts extending vertically downwards therefrom which are removably received in respective ones of said plurality of vertical holes of said left side frame member in order to detachably mount said left side to said left side frame member.

16. A wheelchair system as claimed in claim 14:

wherein said handle assembly includes a pair of vertically extending support bars with free distal ends between which said second linkage is mounted; and wherein said chassis includes a handle mounting means for removably mounting said handle assembly to said chassis, said handle mounting means including a pair of vertical support brackets having holes in which respective ones of said distal ends of said handle support bars are received.

17. A wheelchair system as claimed in claim 16:

wherein said second driven member is a manual turning wheel located at a top of said handle assembly by which said removable driving member of said second linkage is easily rotated to cause said base member and hence said chair mounted thereon to rotate.

18. A wheelchair system for supporting a handicapped person and for transferring the handicapped person in the wheelchair through an automobile door opening and onto an automobile seat, said wheelchair comprising:

a wheeled chassis having a front end and an opposite rear end and being of a height to permit the front end of said chassis to be rolled beneath an automobile door opening;

a handle at the rear end of said chassis;

a chair supporting frame including a horizontally extending base member and a vertically extending support member mounted on said base member;

a rotatable mounting means for rotatably mounting said base member centrally on said chassis, a chair in which a handicapped person sits;

a removable mounting means for removably mounting said chair in a cantilevered manner on an upper end of said vertically extending support member in vertical spaced relation to said wheeled chassis and in a position substantially overlying a length of said base member so that when said chassis is rolled beneath an automobile door opening said chair will be positioned over the automobile seat;

an adjusting means for vertically adjusting a position of said chair with respect to said chassis whereby, when said chair is positioned over an automobile seat, said chair may be lowered onto the automobile seat and said chassis and said chair supporting frame may be disconnected from said chair;

a foot rest;

a foot rest mounting means for mounting said foot rest to said chair for movement in a vertical plane; and a remote adjustment means for incrementally adjusting and holding said foot rest vertically relative to said chair from a position remote from said foot rest whereby legs of the person are easily moved out of the way of the automobile as the chair is positioned through the automobile door opening and onto the automobile seat.

19. A wheelchair system as claimed in claim 18:

wherein said foot rest mounting means includes a mounting bar mounted horizontally for rotation at a front of a seat of said chair and to which said foot rest is attached and a lever attached to one end of said mounting bar; and wherein said remote adjustment means includes a linkage connected to said lever, and a member located remote from said foot rest which is rotated by a tool to activate said linkage and hence to move said lever and the associated said mounting bar incrementally for adjustment and holding of said foot rest.

20. A wheelchair system as claimed in claim 19:

wherein said adjustment means is mounted to said chair; and wherein said member is located adjacent an armrest of said chair.

21. A wheelchair system as claimed in claim 20:

wherein said linkage includes a flexible cord attached at one end to said lever and a spool to which the other end of said flexible cord is attached and about which said flexible cord is wound to adjust and hold said foot rest.

22. A wheelchair system as claimed in claim 19:

wherein said foot rest mounting means further includes a single mounting arm extending from said mounting bar to said foot rest.

23. A wheelchair system as claimed in claim 18, wherein said wheel chassis includes a pair of rear caster wheels which are lockable in a straight forward orientation.

* * * * *